United States Patent [19]

Ford

[11] 3,983,921

[45] Oct. 5, 1976

[54] HAND TRAVERSE ROD WITH EXPOSED BATON

[75] Inventor: James A. Ford, Sherman Township, St. Joseph County, Mich.

[73] Assignee: Kirsch Company, Sturgis, Mich.

[22] Filed: Oct. 16, 1975

[21] Appl. No.: 622,852

[52] U.S. Cl. ..... 160/341

[51] Int. Cl.[2] ..... A47H 5/02

[58] Field of Search ..... 160/330, 340, 341, 126, 160/123; 16/87–87.8

[56] References Cited

UNITED STATES PATENTS

| | | | |
|---|---|---|---|
| 2,419,486 | 4/1947 | Dixon | 160/341 |
| 2,685,337 | 8/1954 | Swafford | 160/341 |
| 3,173,169 | 3/1965 | George | 160/330 X |
| 3,392,420 | 7/1968 | Kless | 160/346 X |
| 3,743,002 | 7/1973 | Ford | 160/341 X |

FOREIGN PATENTS OR APPLICATIONS

| | | | |
|---|---|---|---|
| 1,042,504 | 9/1966 | United Kingdom | 160/341 |

*Primary Examiner*—Philip C. Kannan
*Attorney, Agent, or Firm*—Woodhams, Blanchard and Flynn

[57] ABSTRACT

Means for supporting and propelling a traversable drapery. For supporting and propelling a traversable drapery, there is provided a master carrier having means thereon for resisting side thrust and a baton positioned on the room side of said drapery connected through the drapery to said master carrier. In a preferred embodiment, there is provided a substantially rigid plate fixed to the upper edge of the drapery for the transmission of propelling force therefrom to the drapery and a baton supporting device positioned on the room side of the drapery and connected through the drapery and through said plate solidly to the master carrier whereby to sandwich the drapery firmly between the baton support device and said plate and to sandwich both said plate and said drapery firmly between the baton support device and the master carrier. The baton may consist of flexible or rigid means connected to or integral with the baton support device.

18 Claims, 12 Drawing Figures

HAND TRAVERSE ROD WITH EXPOSED BATON

FIELD OF THE INVENTION

The invention relates to traversable curtain or drapery supports and particularly to simple manually actuable means for effecting traversing of the curtain or drapery along a traverse rod.

BACKGROUND OF THE INVENTION

Traverse rods of many designs have been known for many years and have normally been operated by cords placed externally of the traverse rod for convenient manipulation by the operator with said cords extending into the traverse rod for actuation of the drapery in response to such manipulation. Such arrangements are well known, have been so known for many years and are used in a wide variety of circumstances.

However, in the application of such traverse rods to use in public places, such as motels and hotels, this type of traverse rod has been generally unable to withstand the rough usage to which it is frequently subjected by the traveling public and hence has been unsatisfactory. Hotel or motel guests may often pull directly on the draperies to open or close the same resulting in the jamming or breaking of conventional traverse rod mechanism. Then with such mechanism jammed, or if same has previously been jammed for this or other reasons, a subsequent attempt to open or close the draperies by pulling directly thereon will often tear or otherwise damage same. Attempts by hotel or motel management to maintain conventional traverse rod operating mechanism in good working order is often prohibitively expensive in view of the rapidity and frequency with which same can be and are broken, jammed or otherwise damaged by the traveling public and failure of the hotel management to keep same in good repair not only is highly annoying to subsequent guests but further aggravates the likelihood of tearing or other damage being imposed onto the draperies.

This problem has been long recognized and some attempt has been made to meet it by eliminating the cord operation of such traverse rod and using merely a baton fixed to a carrier for the drapery for effecting traversing of the draperies upon proper manipulation of the baton. This eliminates the problem above mentioned with respect to cord controlled draperies but presents other problems.

Among these other problems, there is first the fact that the baton is normally suspended from the master carrier of the traverse system and hence behind the drapery. This prevents most hotel guests from being aware that the baton exists and hence they will still manipulate the drapery by grasping the leading edge thereof and pulling directly thereon.

Secondly, even when the guest does discover the presence of the baton and utilizes same, he very commonly because of the geometry of the system pulls at least somewhat transversely of the traverse rod at the same time he is pulling along the traverse rod. This transverse force tends to twist the conventional master carrier in the traverse rod which again makes same difficult to move and may in an aggravated case jam it entirely.

One example of a previous attempt to meet this problem is U.S. Pat. No. 3,743,002 to James A. Ford, assigned to the same assignee as the present application, wherein the baton is releasably fastened to a master carrier and arranged for release therefrom in the event of side force applied from the baton to the master in excess of a predetermined maximum. This, while an improvement over the previously known art, still does not fully meet the problem at hand.

Another attempt to meet this problem has utilized an inverted U-shaped member mounted on a master carrier designed to resist side loading with said member extending above and across the drapery to connect with and support a baton on the room side of the drapery. This places the baton where the user can see it but it applies force from the baton to the master through a long and somewhat devious route and utilizes a somewhat unsightly connecting member. Further, this approach limits the height of the drapery with respect to the supporting rod. Thus, the use of batons in previously known ways has thus far failed to solve the problem.

In many other instances the problem is dealt with by providing a relatively heavy drapery which can stand the abuse of being grasped directly for the opening and closing of same but this often requires a drapery material which is otherwise unnecessarily heavy and therefore expensive. Further, even if such material is used, it does not eliminate the possibility of a side thrust being placed onto the master carrier with consequent excessive friction and possible jamming.

Accordingly, the objects of the invention include:

1. To provide a simple cordless system for opening and closing draperies suspended from a traverse rod which will be easy to operate and will minimize the danger of damage to either the drapery suspending means or to the drapery itself.
2. To provide apparatus, as aforesaid, utilizing a baton and employing means for mounting same in direct connection to a master carrier associated with the traverse rod but with such mounting being in a position that the prospective operator can readily see it and recognize its use.
3. To provide apparatus, as aforesaid, in which a baton is mounted on the front side of a drapery but connected through the drapery solidly to a master carrier on which the drapery is supported.
4. To provide apparatus, as aforesaid, in which the carrier is designed for resisting transverse loads placed thereon without generating excessive additional friction between such carrier and the traverse rod track.
5. To provide apparatus, as aforesaid, which is readily adaptable to a number of different specific traverse rod designs together with a number of different specific drapery suspension means.
6. To provide a traverse rod operating means, as aforesaid, which can be readily applied to a number of presently existing traverse rods with a minimum of change in components and which further, if protection against side thrust can be dispensed with, can be applied to virtually any traverse rod suspending system.
7. To provide apparatus, as aforesaid, which will be extremely simple and therefore inexpensive to manufacture and equally simple and therefore inexpensive to apply and utilize.
8. To provide apparatus, as aforesaid, which will be durable, capable of long trouble-free use and whose manner in use will be obvious to virtually any hotel or motel guest.

Other objects and purposes of the invention will be apparent to persons acquainted with apparatus of this general type upon reading the following specification and inspection of the accompanying drawings.

SUMMARY OF THE INVENTION

The above and other objectives are accomplished by providing a master carrier with rollers arranged to withstand a side thrust applied thereto in combination with a baton positioned on the room side of the drapery and fastened through the drapery solidly to the master carrier.

DETAILED DESCRIPTION

Figure 1:
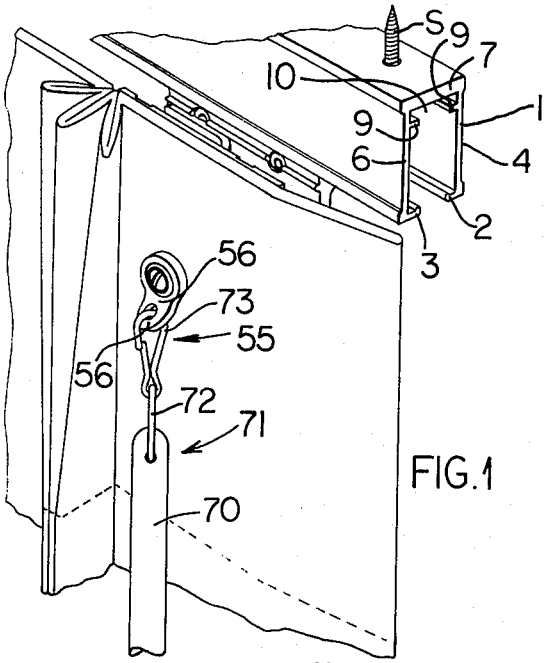
FIG. 1 is a view of the drapery as seen from inside the room showing the baton in operation position.

While the traverse rod hangers and master carrier may take a variety of different forms, the particular ones herein chosen for illustrative purposes will be sufficient to disclose the invention and it will be understood by those skilled in the art as being capable of extensive modification. Referring therefore to FIG. 1 there is here shown a traverse rod in this instance made from extruded aluminum and having a generally rectangular box portion 1 with hanger and master carrier supporting flanges 2 and 3. Upstanding side flanges 4 and 6 and top section 7 are already well known and need no detailed description.

Figure 2:
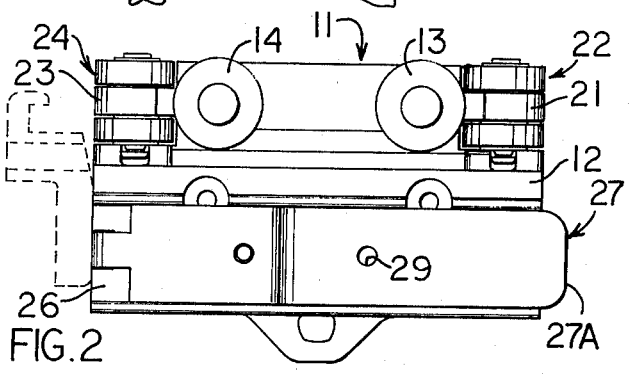
FIG. 2 is a side view of a typical master carrier as used with the invention.

Referring now to FIG. 2 there is shown a master carrier 11 having a body 12 supporting first and second rollers 13 and 14, said rollers 13 and 14 supporting the weight of the master carrier and the drapery hung therefrom on the flanges 2 and/or 3 in a generally presently known manner. Said body portion 12 also has a forwardly extending abutment 21 carrying a pair of rollers 22 rotatable about a vertical axis and said body member further carries a rearwardly extending abutment 23 carrying a pair of rollers 24 also supported on a vertical axis rotatably with respect thereto. Said rollers 22 and 24 bear against upstanding flanges 4 and 6 to resist twisting of the carrier within the rod in response to a lateral force applied to the flange 26 depending from said body portion. A drapery support 27 is carried on the depending flange 26, is provided with the usual offset 28 for overlap purposes and includes at least one opening, such as at 29, normally provided for receiving a drapery supporting hook.

Flanges 9 of the rod receive upward thrust of the master carrier, if same is carelessly operated, by receiving pressure of rollers 13 and 14 thereagainst. Space 10 is provided for the head of fastening screws S by which the rod is mounted.

Figure 3:
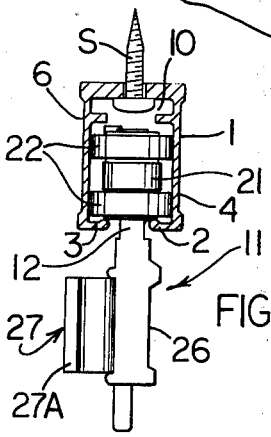
FIG. 3 is a transverse section taken through the rod at any point adjacent the master carrier of FIG. 2 and showing same in position.

It will be apparent upon inspection of FIG. 3 wherein the relationship of the master carrier to the traverse rod is illustrated that same will resist a twisting action imposed thereon by side thrust applied to the depending flange 26 or the support bar 27. It will also be apparent that a variety of other designs of both the traverse rod and the master carrier effective for resisting such side thrust can be provided.

Figure 5:
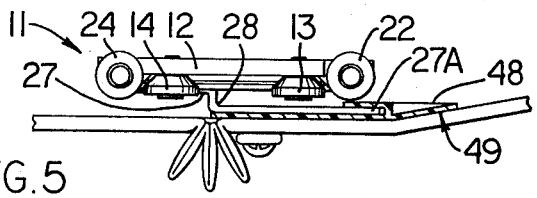
FIG. 5 is a top view of the master carrier of FIG. 2 shown in association with the drapery and attachment means shown in FIG. 4.

Turning now to the components utilized with the drapery, there is first shown a conventional head tape 40 and an attaching plate 41, which in this embodiment is of vertical dimension substantially equal to that of the head tape 40. The plate 41 has grooves 42 providing thinned sections for the convenient stitching of said plate to the drapery by stitch lines 43. An opening 44 is provided in said plate for reasons appearing hereinafter and an opening in register therewith (not shown) is provided through the drapery. A block 46 is fixed to the plate 41 preferably by being molded integrally therewith and has a recess 47 therein of size to receive in snug relationship therewith the free end 27A of the drapery supporting bar 27. In this embodiment, and preferably, there is provided on said block 46 a projecting end 48 which has a tapered surface 49 and an opening 51. By stitching as indicated at 52 the drapery closely against the projecting end 48, and in this case the sloped surface 49, the drapery is caused to angle outwardly slightly as best shown in FIG. 5 to improve the overlap.

Baton means 55 comprise a baton support 56 and a baton 71, which latter here comprises a hand grip 70 and means hereinafter further described for connecting the hand grip 70 to the baton support 56.

Figure 6:
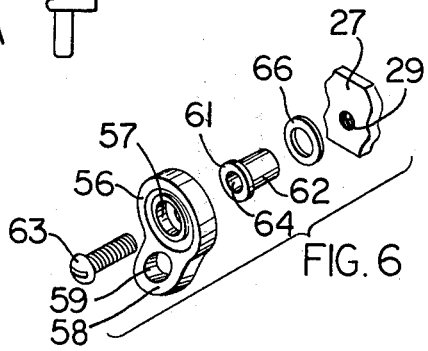
FIG. 6 is an exploded oblique view of the baton support and of the means fastening same to the master carrier.

The baton support 56 has an opening 57 (FIG. 6) therethrough and a baton supporting tab 58 depending therefrom. The baton supporting tab has an opening 59 therein for purposes appearing hereinafter.

An eyelet having a flange 61 and shank 62 is positioned to extend through the above-mentioned opening in the drapery and the opening 44 in the plate 41. A screw 63 then extends through the opening 57, the central opening 64 in the eyelet and is fixed in place by means of a washer and a nut, if desired, or as here by being threaded into the opening 29 of bar 27.

The baton 71 is supported on the baton support, here by connecting the hand grip 70 to said tab 58 in any convenient manner such as by a ring 72 and hook 73.

With this arrangement, the baton means 70 is on the side of the drapery toward the user and adjacent the edge thereof so that same will be in full view of the user and as easy for the user to grasp as the edge of the drapery. This accordingly increases greatly the chances of the baton means being used to move the drapery instead of the user's grasping the edge thereof. Further, the resistance of the master carrier to tilting will enable same to move smoothly in response to force applied thereto from the baton means even though said force is applied at a sufficient angle through the lengthwise extent of the traverse rod that there is a substantial component of force applied to the master carrier transversely of the traverse rod as well as longitudinally thereof. Accordingly, the drapery will be easy and convenient to move and yet the maintenance of cords, and the undesirable consequences of the lack of such maintenance, will be eliminated. At the same time the drapery will be enabled to move smoothly even though the user, as often happens, applies a substantial transverse force to the master carrier as well as the desired longitudinal force.

Figure 4:
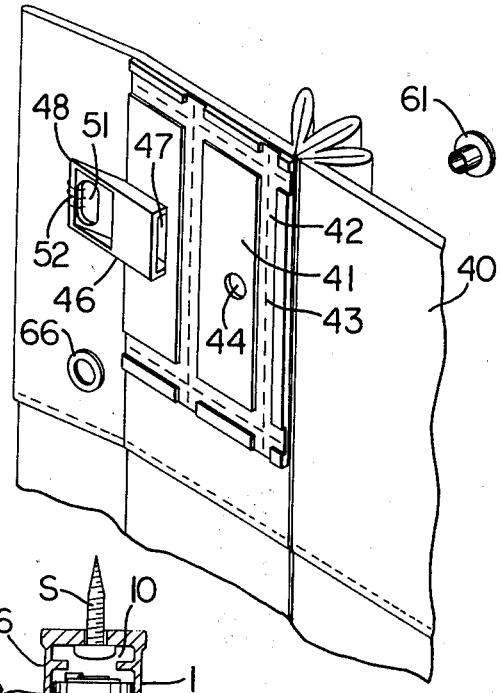
FIG. 4 is a view of the drapery with the traverse rod removed and showing the means attached to the drapery for operatively connecting same to the master carrier of the traverse rod system.
Figure 7:
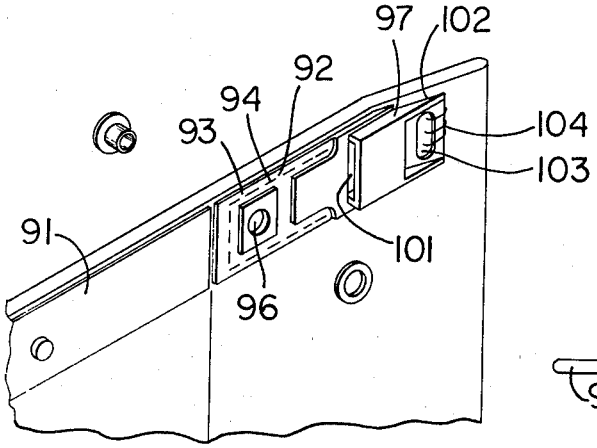
FIG. 7 shows the manner of applying the system of the invention to a curtain supporting system such as that shown in U.S. Pat. No. 3,522,621 wherein the tape fixed to the upper edge of the drapery is relatively narrow.
Figure 8:
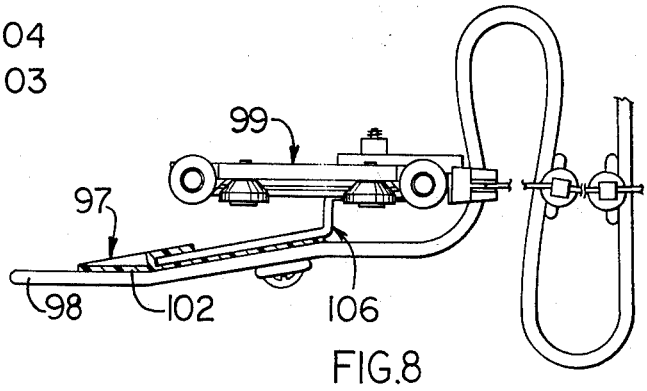
FIG. 8 is a top view similar to FIG. 5 of the parts shown in FIG. 7 in association with a master carrier as shown in FIG. 2.

FIGS. 7 and 8 illustrate another type of drapery support system such as that shown in U.S. Pat. No. 3,522,621. Here a somewhat narrower head tape 91, as compared to the head tape 40 in FIG. 4, is utilized and the stiffener 92 is modified appropriately. Same is, however, still made of a vertical distance substantially equal to the vertical dimension of the tape 91 and is provided with portions 93 of reduced thickness to facilitate the application of stitching 94 for fastening of the stiffener through said tape to the drapery. An opening 96 is provided corresponding in function to the opening 44 in FIG. 4. A block 97 is provided similar to the block 46 of FIG. 4 for the reception of the supporting bar 98 of the master carrier 99. As previously, the block 97 includes receptacle 101, the tapered surface 102 and opening 103 for cooperation with the stitching 104, all corresponding to and in more detail described in connection with FIG. 4.

The master assembly 99 can be of any desired type, preferably one which will resist tilting as above shown in connection with FIGS. 1–6 and carries offset arm 106 generally similar to the offset arms presently conventionally used to overlap draperies. The end of said arm is received into the receptacle 101 of the block 97 and holds the edge of said drapery properly for overlapping with an adjacent drapery. The baton is connected in the same manner as already above described through the opening 96 and functions therewith in the same manner as already above described.

While the preferred form of the invention is as above described, it will be apparent in view of the foregoing that some of the objects of the invention can be accomplished by use of a baton mounted as above described but used with a conventional master carrier, i.e., a master carrier not provided with means for resisting side thrust. Such a baton will at least be visible to the user and will normally be grasped instead of the drapery. However, a carrier not equipped to resist side thrust will be subject to increased friction and possible jamming and hence it is preferable to provide a baton as described in combination with a carrier equipped to withstand side thrust.

While the baton shown in the drawings is a solid member connected by flexible linkage to the master carrier, it will be recognized that the baton structure may vary widely from being a wholly flexible linkage, as a chain, to a solid member fixed rigidly through the drapery to the master carrier, as by being molded solidly with the baton support means.

Figure 10:
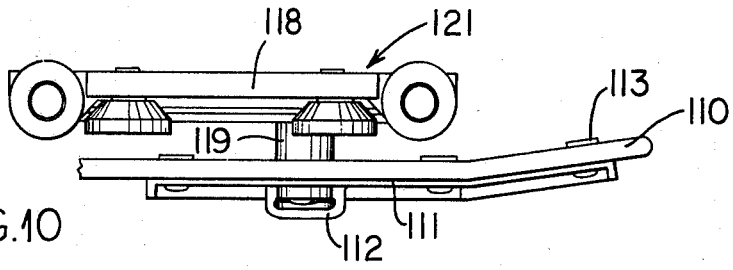
FIGS. 9 and 10 show the application of the invention to a further alternate construction, here for reducing the number of parts.
Figure 9:
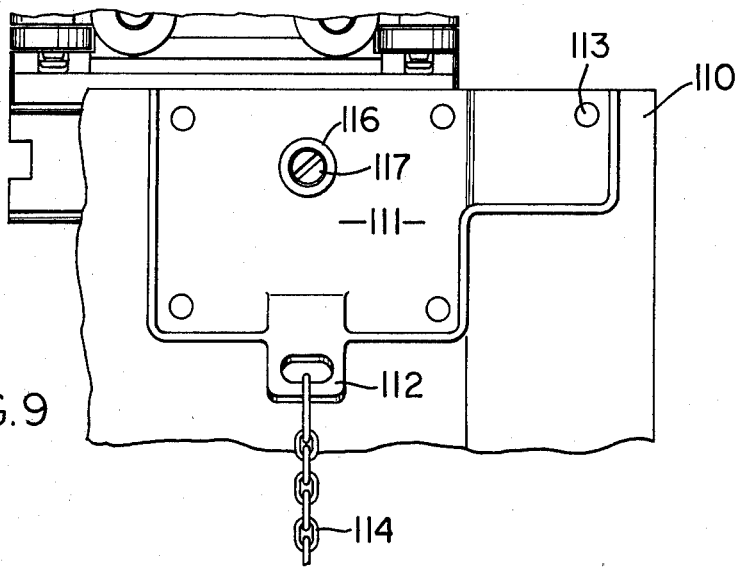

It will be recognized that a major function of the attaching plate 41 is to provide ample means for transmitting force from the baton to the drapery and the construction as above described is convenient and effective. However, it will be recognized that at least the broader objectives of the invention will be accomplished by other means fixed solidly to either the baton support 56, or to the master carrier, for transmitting force applied to either thereof to said drapery. Thus, for example, for a low cost and high production arrangement, the plate may be molded integrally with either the master carrier or the baton support and fixed by rivets or staples to the drapery. In FIGS. 9 and 10 there is shown a plate 111 molded integrally with the baton support 112, arranged on the room side of the drapery 110 and fixed by rivets 113 to said drapery. The baton support is then connected at 116 by a screw 117, with or without an eyelet corresponding to eyelet 61 as desired, through the drapery and fixed solidly and rigidly in any suitable manner to the master carrier 118. Here the screw enters into and the drapery 110 is held against, a post 119 mounted on and extending from the depending flange 120 of a master carrier 121 which latter may otherwise by identical with the master carrier 11 of FIGS. 1–5. In this case, the baton suspended from the baton support is shown as a flexible chain 114.

Figure 11:
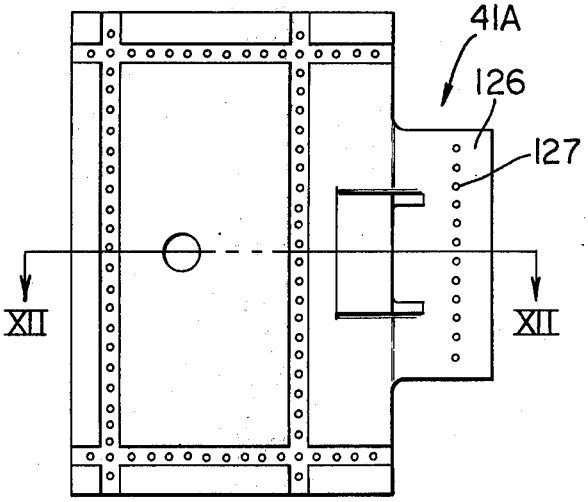
FIG. 11 shows a further modification of a portion of the baton attachment means.
Figure 12:
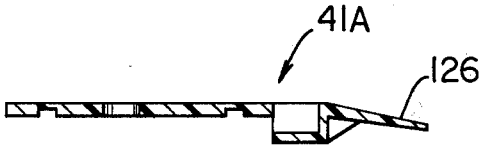
FIG. 12 is a sectional view taken on line XII—XII of FIG. 11.

FIGS. 11 and 12 show a modification 41A of the plate 41 in which the projecting end 48 of the FIG. 4 embodiment is modified to comprise a sew tab 126 having sewing perforations 127 instead of the loop opening 51. A similar modification (not illustrated) may, if desired, be made in the FIG. 7 embodiment.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Means for supporting a drapery on and from a traverse rod and for manually effecting movement of said drapery therealong comprising:

a master carrier supported for longitudinal movement on and along said rod;

a drapery supported at least in part from said master carrier;

baton means positioned on the side of said drapery opposite said master carrier and means extending through said drapery connecting said baton to said master carrier.

2. The device of claim 1 wherein said master carrier includes guide means for resisting a force applied thereto having a component transverse of the longitudinal extent of the traverse rod.

3. The device of claim 2 wherein said guide means is internal of the rod and bears against an internal wall thereof.

4. The device of claim 1 wherein said master carrier includes a guide means having at least one roller mounted on a vertical axis and bearable against a portion of said traverse rod for resisting force applied to said master carrier having a component transverse to the longitudinal extent of said traverse rod.

5. The device of claim 1 wherein said baton means is affixed solidly through said drapery to said master carrier.

6. The device of claim 1 wherein said baton means comprises a baton support affixed solidly through said drapery to said master carrier, a baton and means connecting the baton to said baton support.

7. The device of claim 6 including a plate fixed to the upper edge of said drapery for stiffening of same and interposed between said baton support and said master carrier and fastening means rigidly and tightly fixing together said baton support, drapery and plate;

whereby force applied from said baton to said baton support will be transmitted solidly and efficiently to both said drapery and said master carrier.

8. The device of claim 7 wherein said plate is affixed to said drapery by being stitched thereto.

9. The device of claim 7 wherein said plate is affixed to said drapery on the side thereof facing said master carrier whereby the drapery is sandwiched between said baton support and said plate.

10. The device of claim 7 wherein said master carrier includes a projecting arm and reception means on said plate for receiving the end of said arm.

11. The device of claim 7 including a tab projecting beyond said plate and means accommodating stitching for holding the free end of said tab snugly to said drapery.

12. The device of claim 11 wherein a portion of the surface of said plate facing said drapery is positioned at an angle to the remainder of said surface to direct the portion of said drapery lying thereagainst at an angle to the general longitudinal direction thereof.

13. The device of claim 10 including a tab projecting beyond said plate, wherein said reception means comprises socket means located within said tab.

14. The device of claim 7 wherein said plate is molded integrally with one of said baton support and said master carrier.

15. The device of claim 1 wherein said baton means is at least in part a flexible chain.

16. The device of claim 1 wherein said baton means is rigid.

17. The device of claim 1 wherein the rod includes internal flange means spaced from the bottom of said rod and arranged to receive and resist upward movement of said master carrier.

18. The device of claim 3 wherein the rod includes internal flange means spaced from the bottom of said rod and arranged to receive and resist upward movement of said master carrier, whereby the master carrier will be held firmly against movement in all transverse directions while being permitted movement longitudinally of the rod.

* * * * *

UNITED STATES PATENT OFFICE

CERTIFICATE OF CORRECTION

Patent No. 3 983 921 Dated October 5, 1976

Inventor(s) James A. Ford

It is certified that error appears in the above-identified patent and that said Letters Patent are hereby corrected as shown below:

Column 1, line 52; after "hence" insert ---hangs---.

Please add the following claim:

-19-

The device of Claim 7 wherein said master carrier includes a projecting arm and said plate includes means thereon for inter-engaging with the end of said arm.

Signed and Sealed this

First Day of March 1977

[SEAL]

*Attest:*

RUTH C. MASON
*Attesting Officer*

C. MARSHALL DANN
*Commissioner of Patents and Trademarks*